US008723429B2

(12) United States Patent
Yao et al.

(10) Patent No.: US 8,723,429 B2
(45) Date of Patent: May 13, 2014

(54) FLUORESCENT BALLAST END OF LIFE PROTECTION

(75) Inventors: Gang Yao, Mayfield Heights, OH (US); James Mieskoski, East Cleveland, OH (US)

(73) Assignee: General Electric Company, Schenectady, NY (US)

( * ) Notice: Subject to any disclaimer, the term of this patent is extended or adjusted under 35 U.S.C. 154(b) by 114 days.

(21) Appl. No.: 13/439,939

(22) Filed: Apr. 5, 2012

(65) Prior Publication Data

US 2013/0264952 A1 Oct. 10, 2013

(51) Int. Cl.
*H05B 37/02* (2006.01)

(52) U.S. Cl.
USPC ..... 315/178; 315/299; 315/250

(58) Field of Classification Search
None
See application file for complete search history.

(56) References Cited

U.S. PATENT DOCUMENTS

| | | | | |
|---|---|---|---|---|
| 6,081,077 | A * | 6/2000 | Canova et al. | 315/307 |
| 6,359,387 | B1 * | 3/2002 | Giannopoulos et al. | 315/46 |
| 6,366,031 | B2 * | 4/2002 | Klien | 315/291 |
| 7,589,472 | B2 * | 9/2009 | Keith et al. | 315/94 |
| 8,125,154 | B2 * | 2/2012 | Hui et al. | 315/46 |
| 8,421,360 | B2 * | 4/2013 | Mishima et al. | 315/129 |
| 2011/0002780 | A1 * | 1/2011 | Higashimori | 415/203 |
| 2011/0006699 | A1 | 1/2011 | Nerone | |
| 2011/0012530 | A1 * | 1/2011 | Zheng et al. | 315/294 |
| 2011/0062879 | A1 * | 3/2011 | Yadlapalli et al. | 315/250 |
| 2011/0291577 | A1 * | 12/2011 | Anissimov | 315/224 |

* cited by examiner

*Primary Examiner* — Crystal L Hammond
(74) *Attorney, Agent, or Firm* — Peter T. DiMauro; GE Global Patent Operation

(57) ABSTRACT

A system and method of controlling a lighting system having a ballast is provided. The ballast may be used in a lamp system that utilizes different types of lamps. The ballast may detect a lamp signal that indicates a change in state of at least one of the lamps in the lighting system. A voltage regulator signal can be modified based on the detected lamp signal and the light system controlled based on the modified voltage regulator signal.

18 Claims, 4 Drawing Sheets

FLUORESCENT BALLAST END OF LIFE PROTECTION

FIELD OF THE INVENTION

The present disclosure relates to a ballast in a lighting system and more particularly to a system and method for implementing end-of-life protection for various lamp types.

BACKGROUND OF THE INVENTION

Fluorescent lamps include filaments or electrodes at each end of a glass tube, an ionizable gas and a phosphor coating on the inside of the glass tube. When current is supplied to the filaments, a voltage is induced, ionizing the gas and forming an electric arc between the filaments. The electric arc generates a flow of electric current through the ionized gas causing electrons to be excited and producing light emissions. Typically, the filaments are coated with an emission mix to facilitate electron emission. The use of a ballast in a fluorescent lamp system extends the life of the lamps by preheating the filaments to mitigate the depletion of the emission mix coating.

A lamp reaches an end-of-life stage when the emission mix becomes depleted on a filament causing the lamp to draw more voltage to continue normal operation. This higher voltage results in an increase in lamp temperature which may damage the lamp or the lamp socket.

Conventionally, when an end-of-life stage is detected in one of the lamps, a lamp control circuit would disengage power from all the lamps in the system. This prevents a visual detection of the lamp that has reached the end-life-stage which is undesirable for replacement.

An alternative to disengaging power from all lamps in the system is to include a lamp signal detector and circuit driving elements for each lamp. When an end-of-life stage is detected in a lamp, then only that lamp is disengaged from the power. However, this configuration will not work for a lamp system connected in parallel. It also adds additional cost and complexity.

In addition, traditional ballasts are configured to be used in a lighting system having a uniform lamp type. This means that ballasts must be changed every time a lamp type changes. With the constant improvement of lamps, upgrading to a new ballast is costly and inefficient.

BRIEF DESCRIPTION OF THE INVENTION

To address one or more of the above shortcomings, embodiments of the invention provide a lighting system and/or method of controlling a lighting system that can use different types of lamps. In contrast to prior systems and methods, embodiments of the invention are configured to detect lamp outputs for lamps that are coupled in parallel. Additionally, the detected lamp outputs are used to modify a voltage command signal provided by a voltage regulator for each lamp type.

Embodiments of the present disclosure provide a system and/or a method of controlling a lighting system having a ballast. The lighting system may be a fluorescent lighting system. Unlike prior systems where using a different type of lamp requires a new ballast, embodiments of the ballast, and/or other components of the lighting system described herein can be used in a lighting system with different types of lamps, because embodiments of the ballast are configured to automatically determine and adjust voltage levels to those that are appropriate for the types of lamp being used. For example, embodiments of the ballast can detect a lamp signal that indicates a load condition of at least one of the lamps in the lighting system. A voltage regulator signal can be modified based on the indicated load condition. This is different from prior systems because a plurality of predetermined operational ranges for each load condition are not necessary in a ballast that is configured for driving a single load condition associated with a particular type of lamp.

One exemplary aspect of the present disclosure is directed to a lighting system. The lighting system can include a ballast having a lamp power circuit and a voltage regulator where the lamp power circuit is configured to provide an output voltage to a plurality of lamp sockets based on a voltage command received from the voltage regulator. The lighting system can also include a lamp detection circuit coupled to the ballast, where the lamp detection circuit is configured to detect a load condition on at least one of the plurality of lamp sockets and provide an output to the voltage regulator indicative of the load condition. The voltage regulator can be further configured to adjust the voltage command provided to the power circuit based on the output of the lamp detection circuit.

Another exemplary aspect of the present disclosure is directed to a method for controlling a lighting system. The method includes providing an output from a lamp detection circuit to a voltage regulator where the output is based on an electrical property detected by the lamp detection circuit. A load condition can be identified at the voltage regulator based on the lamp detection circuit output. A voltage command can be provided from the voltage regulator to the lamp power circuit based on the load condition. The method further includes adjusting the voltage applied by the lamp power circuit to at least one of a plurality of lamp sockets based on the voltage command.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

Reference is now made briefly to the accompanying drawings, in which.

DETAILED DESCRIPTION OF THE INVENTION

Figure 1:
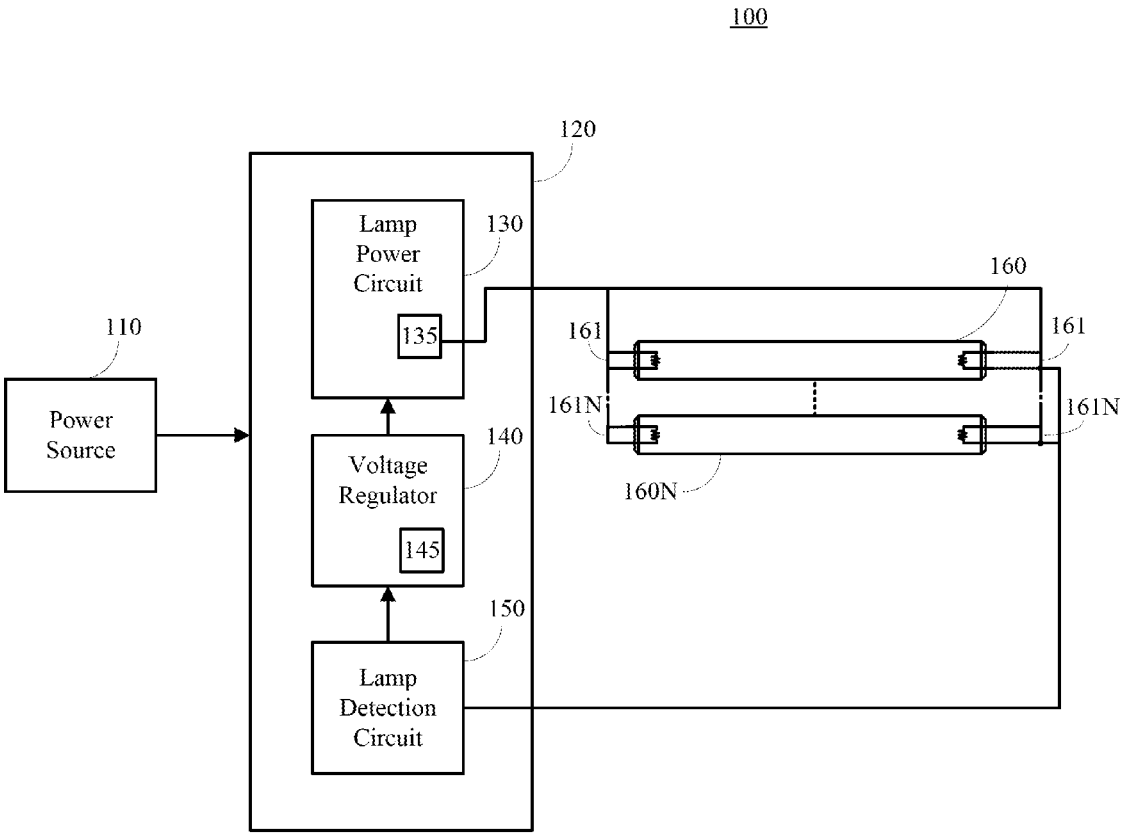
FIG. 1 provides a block diagram of an exemplary lighting system according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that embodiments of the present invention cover such modifications and variations as come within the scope of the appended claims and their equivalents.

As illustrated in FIG. 1, an embodiment of a lighting system 100 can include one or more of the following: a power source 110, a ballast 120, and lamp sockets 161, 161N. Lamp sockets 161, 161N are configured to receive and power lamps 160, 160N.

Lamps 160, 160N can be fluorescent lamps or any other type of lamp that utilizes a ballast 120 for ignition and/or control. Numerous lamp types can be used in lighting system 100. For example, fluorescent lamps having different wattages, such as 14W, 20W and 28W can be used within the lighting system 100 using the same ballast 120.

Power source 110 supplies power to operate the lighting system 100. The power source 110 can be any type of power source. For example, the power source 110 may be a household AC power source, such as a wall socket that is coupled with a source of electrical energy. Alternatively, the power source 110 may be any DC power source such as an energy storage device, a fuel cell or battery.

When manufactured, sold and/or shipped, embodiments of the lighting system 100 may include only the ballast 120, preferably with one or more of its sub-components, lamp power circuit 130, voltage regulator 140 and lamp detection circuit 150, or may include the ballast 120 and the lamp sockets 161, 161N, with or without one or more lamps 160, 160N installed therein. One or more of the sub-components, including the lamp power circuit 130, voltage regulator 140 and lamp detection circuit 150, may be formed on a printed circuit board (PCB). This PCB may be manufactured, shipped and/or sold separately or together with the ballast 120 and/or the light sockets 161, 161N. Alternatively, one or all of the sub-components may be separate devices. For example, the lamp detection circuit 150 may be a separate component but coupled to the ballast 120. There may be any number of lamps 160, 160N included in lamp system 100. When there is more than one lamp, the lamps can be coupled to ballast 120 in parallel.

Ballast 120 can include a lamp power circuit 130 coupled with a light socket 161, 161N, a voltage regulator 140 coupled with the lamp power circuit 130, and a lamp detection circuit 150 coupled with the voltage regulator 140. In addition, ballast 120 can also include a DC power circuit and a rectifier (not shown). Alternatively if the power source is a DC source or additionally, when an alternative voltage level is desired, a DC-DC converter may be included in ballast 120.

Lamp power circuit 130 can include any elements or devices for driving the lamps such as an inverter, switches, ballast capacitors and/or a ballast inductor. The lamp power circuit 130 operates under the control of a voltage regulator 140 and a suitable start circuit (not shown). Lamp power circuit 130 can provide an output voltage to at least one lamp socket 161, 161N to operate and control the lamps.

Voltage regulator 140 can regulate the voltage supplied to the lamp sockets 161, 161N via lamp power circuit 130 by generating a voltage command based on the output of the lamp detection circuit 150. The lamp power circuit 130 supplies the voltage to the lamp sockets 161, 161N using a high frequency bus.

The voltage regulator 140 can be a circuit of various elements such as capacitors, diodes, MOSFETs, etc. Alternatively, voltage regulator 140 can include a microprocessor that may have a memory and microprocessor, CPU or the like, such as a general or special purpose microprocessor operable to execute programming instructions or micro-control code associated with light system control. The memory may represent random access memory such as DRAM or read only memory such as ROM or FLASH. In one embodiment, the processor can execute programming instructions stored in memory. If voltage regulator 140 includes a memory, the memory may be a separate component from the processor or may be included onboard within the processor.

According to an aspect of the present disclosure, the voltage regulator can determine the load condition of a lamp socket and provide a voltage command associated with the load condition. As used herein, a load condition corresponds to the type or wattage of the lamp inserted. A plurality of operating conditions can be associated with each load condition. The operating conditions correspond to the various operating stages of a lamp. For example, an operating condition can include a startup condition, a normal operating condition and an end-of-life condition.

After a new lamp is inserted into a lamp socket 161, 161N, an electrical property is detected by the lamp detection circuit 150. This electrical property is indicative of a load condition of the newly inserted lamp. For instance, the electrical property is indicative of wattage of the newly inserted lamp. The lamp detection circuit 150 provides an output to the voltage regulator 140 indicative of the load condition. The voltage regulator 140 uses the output of the lamp detection circuit 150 to determine what type of lamp 160, 160N is inserted into the lamp socket 161, 161N. This determination may be implemented in various ways such as using a look-up table stored in the voltage regulator 140 or a comparator circuit in the voltage regulator 140. For example, a new lamp 160, 160N is inserted into lamp socket 161, 161N and an electrical property of a first value is received by the lamp detection circuit 150. The electrical property is provided to the voltage regulator 140 and the voltage regulator 140 compares the detected electrical property with known electrical properties in a lookup table 145. When the first value indicates that the inserted lamp has a first load condition, such as 14W, the lookup table 145 may include a plurality of predetermined voltages to drive the lamp during a plurality of operating conditions associated with the first load condition.

The voltage regulator 140 can adjust the voltage commands provided to the lamp power circuit based on the detected and identified lamp operating condition. For example, the voltage regulator 140 can generate a voltage command that corresponds to a startup condition immediately following the new lamp 160, 160N being inserted into the lamp socket 161, 161N. More specifically, the voltage command indicates that a voltage should be increased across the lamp socket 161, 161N corresponding to the newly inserted lamp. After a predetermined time interval, the voltage regulator 140 can generate a voltage command indicative of normal operating conditions, which may be a voltage value less than the voltage used during the startup condition.

When the lamp reaches an end-of-life stage, (e.g., a stage where the emission mix coating on at least one filament is depleted), the lamp requires more voltage to operate at a normal operating condition. This change in voltage can be detected at the lamp detection circuit 150 as a detected electrical property. The output of lamp detection circuit 150 is provided to the voltage regulator 140 and the voltage regulator 140 can adjust the voltage command according to the end-of-life operating condition.

Various things can happen during an end-of-life condition of the lamp including reducing current or voltage to the lamp so the lamp enters a glow state where the luminance is significantly reduced from normal operation, giving a visual indicator of which lamp needs to be replaced in the lighting system. Alternatively, the current or voltage to the lamp in end-of-life condition can be terminated and the lamp would be extinguished while the remaining lamps continue normal operations.

Lamps 160, 160N can be controlled during an end-of-life operating condition in various ways. For example, the voltage regulator 140 can adjust the voltage command to indicate that the lamps not in an end-of-life operating condition should continue to be driven based on normal operation conditions while the lamp in the end-of-life condition should be driven using a different voltage value such as a lower voltage value corresponding to both the startup condition and the normal operating condition. This value may be a reduced voltage value which would allow the lamp to continue emitting light but in a lower or glow state. Alternatively, the voltage value may be zero and the lamp in the end-of-life stage would no longer emit light.

Lamp detection circuit 150 may detect an electrical property such as a voltage or a current from the lamps 160, 160N. The net electrical property for all lamps can be used as a feedback to the voltage regulator 140. Alternatively, an electrical property for each lamp may be detected by the lamp detection circuit 150 and then the lowest value may be used as a feedback to the voltage regulator 140. In addition, lamp detection circuit 150 can detect current signals separately or in combination with the voltage signals to communicate feedback to the voltage regulator 140. The outputs of the lamp detection circuit can be detected individually and then combined by the voltage regulator or they can be detected simultaneously by the lamp detection circuitry 150 and a single output provided to the voltage regulator 140.

Figure 2:
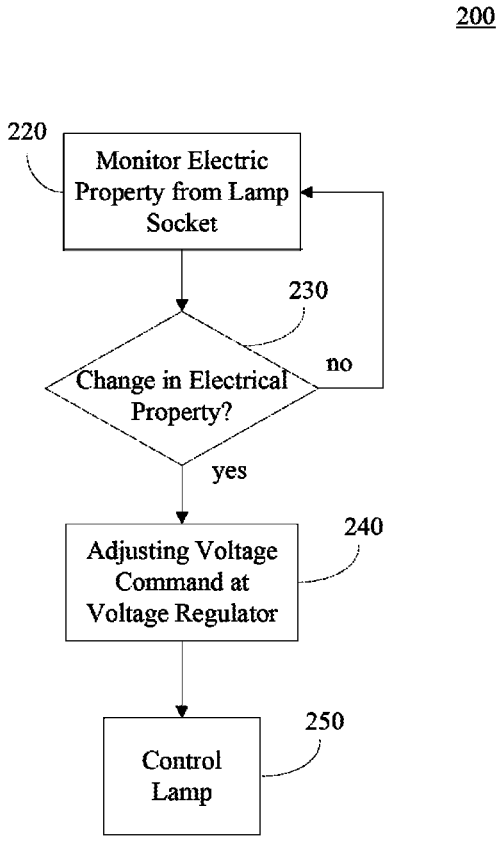
FIG. 2 provides a flow chart of a method of controlling the lighting system according to an exemplary embodiment of the present disclosure.

FIG. 2 illustrates a flow chart of an exemplary method 200 according to an exemplary embodiment of the present disclosure. The method 200 will be discussed with reference to the exemplary lighting system illustrated in FIG. 1. However, the method 200 can be implemented with any suitable lighting control system. In addition, although FIG. 2 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

At 220, the lamp detection circuitry 150 monitors an output from the lamp sockets 161, 161N for an electrical property. When a change in electrical property is detected at 230, the lamp detection circuit 150 provides an output to the voltage regulator 140 indicative of the electrical property. The voltage regulator 140 provides an adjusted voltage command to the lamp power circuit at 240 based on the output received from the lamp detection circuit 150. The lamp power circuit controls the lamps 160, 160N at 250 based on the adjusted voltage command.

For example, when a lamp 160, 160N reaches an end-of-life condition, the voltage of the lamp increases and the lamp detection circuit provides a signal indicative of the change in voltage to the voltage regulator 140. Based on this signal, the voltage regulator provides an adjusted voltage command to modify the high frequency bus 135 voltage output based on the change in voltage at the lamp. In particular aspects, the voltage regulator 140 can include a predetermined table where voltage changes are correlated to a voltage command using a look-up table. Alternatively, the voltage regulator 140 can dynamically determine and/or calculate a voltage command to the power circuit 130.

The high frequency bus 135 voltage output can be modified either up or down in voltage based on the voltage command. In addition, when a lamp is removed from the system or is extinguished due to end-of-life, the voltage command provided by the voltage regulator 140 can be modified to regulate the voltage applied by the high frequency bus 135 voltage regulator 140 to the remaining ignited lamps in the system.

Figure 3:
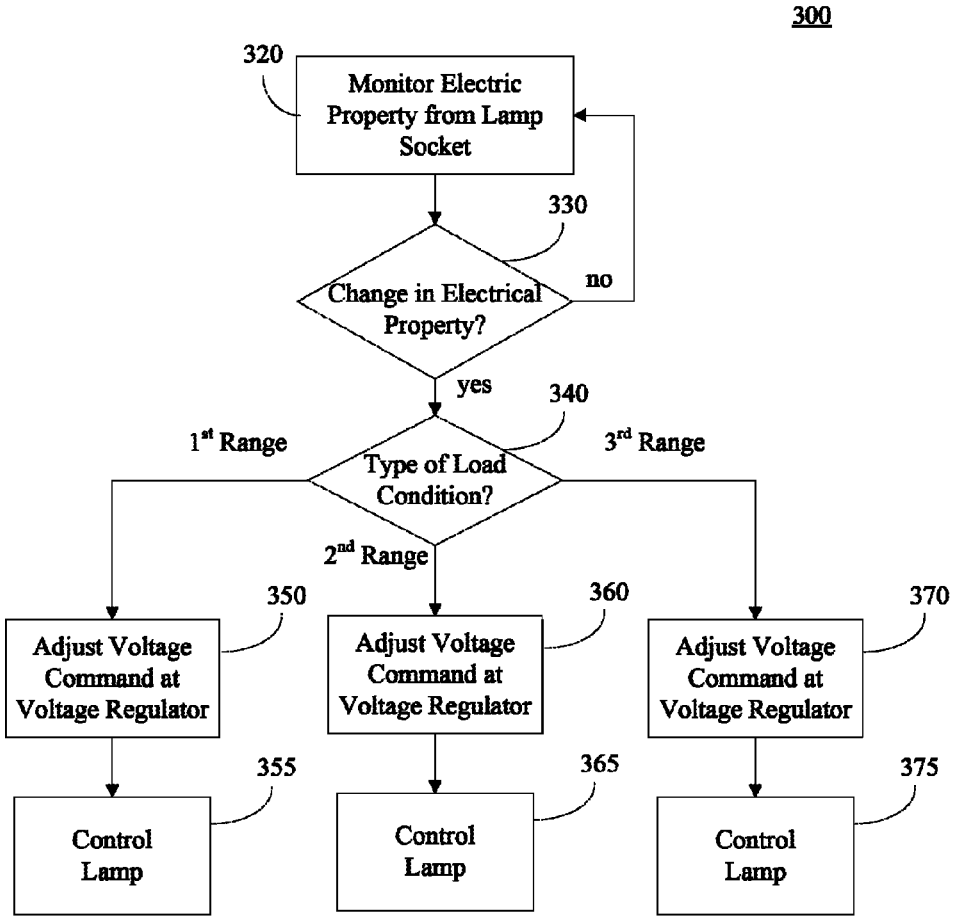
FIG. 3 provides a flow chart of a method of controlling the lighting system according to an exemplary embodiment of the present disclosure.

FIG. 3 illustrates a flow chart of an exemplary method 300 according to an exemplary embodiment of the present disclosure. The method 300 will be discussed with reference to the exemplary lighting system illustrated in FIG. 1. However, the method 300 can be implemented with any suitable lighting control system. In addition, although FIG. 3 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

At (320), the lamp detection circuitry 150 monitors an output from the lamp sockets 161, 161N for an electrical property. When a change in electrical property is detected at 330, the lamp detection circuit 150 provides an output to the voltage regulator 140. The voltage regulator 140 determines the load condition of the new lamp at 340 based on the output from the lamp detection circuit 150. When the detected electrical property is within a first range, the voltage regulator 140 identifies the load condition and adjusts a voltage command to adjust an output to the lamp power circuit according to the corresponding first range 350 and the lamp power circuit controls the lamps 160, 160N at 355 based on the received voltage command. When the detected electrical property is within a second range, the voltage regulator 140 identifies the load condition and adjusts a voltage command to adjust an output to the lamp power circuit according to the corresponding second the range (at 360) and the lamp power circuit controls the lamps 160, 160N (at 365) based on the received voltage command. When the detected electrical property is within a third range, the voltage regulator 140 identifies the load condition and adjusts a voltage command to adjust an output to the lamp power circuit according to the corresponding third range (at 370) and the lamp power circuit controls the lamps 160, 160N (at 375) based on the received voltage command.

For example, if the first predetermined range is to correspond to a load condition of a lamp having a first wattage, such as 14 W, the voltage regulator 140 can include a predetermined lookup table or dynamically calculate a voltage command based on this type of lamp. The voltage command can similarly be determined for the second and third load conditions.

Figure 4:
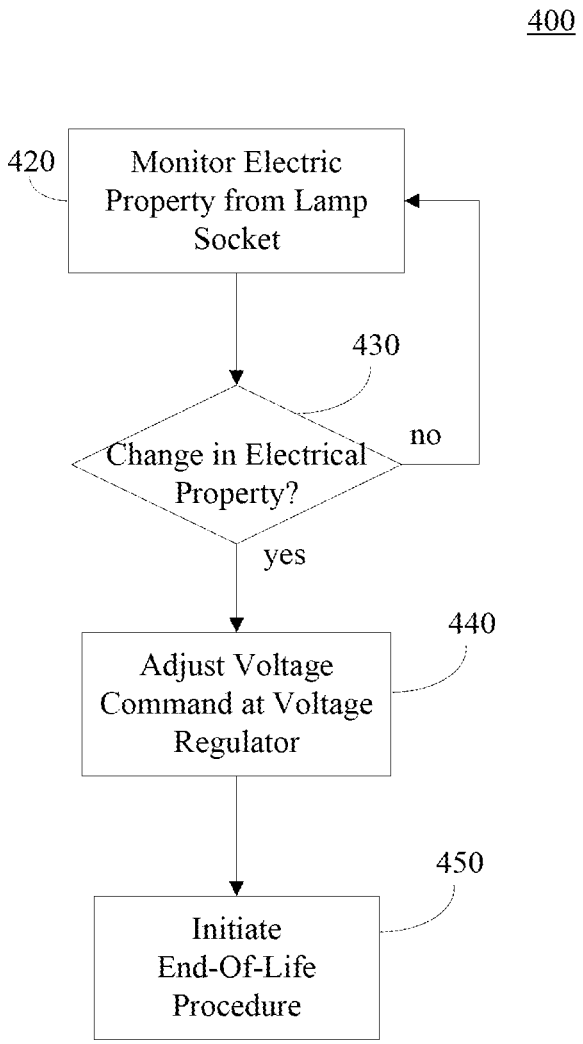
FIG. 4 provides a flow chart of a method of controlling the lighting system according to an exemplary embodiment of the present disclosure.

FIG. 4 illustrates a flow chart of an exemplary method 400 according to an exemplary embodiment of the present disclosure. The method 400 will be discussed with reference to the exemplary lighting system illustrated in FIG. 1. However, the method 400 can be implemented with any suitable lighting control system. In addition, although FIG. 4 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

At 420, the lamp detection circuitry 150 monitors an output from the lamp sockets 161, 161N for an electrical property. When a change in electrical property is detected at 430, the lamp detection circuit 150 provides an output to the voltage regulator 140. When an electrical property indicative of an end-of-life operating condition is detected, the voltage command is adjusted by the voltage regulator according to the corresponding end-of-life operating condition at 440 and an end-of-life procedure is initiated at 450. The end-of-life procedure can include shutting down the individual lamp or reducing the power to the end-of-life lamp to enter a glow state while maintaining normal operation conditions to the other lamps coupled in parallel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A lighting system, comprising:

a ballast having a lamp power circuit and a voltage regulator, the lamp power circuit configured to provide an output voltage to a plurality of lamp sockets based on a voltage command received from the voltage regulator; and a lamp detection circuit coupled to the ballast, the lamp detection circuit configured to detect a lamp type on at least one of the plurality of lamp sockets and provide an output to the voltage regulator indicative of the lamp type, wherein the voltage regulator is further configured to adjust the voltage command provided to the power circuit based on the output of the lamp detection circuit.

2. A lighting system as in claim 1, wherein the lamp type is selected from a plurality of lamp types.

3. A lighting system as in claim 2, wherein a plurality of operating conditions are associated with each of the plurality of lamp types, the plurality of operating conditions comprising a startup condition, a normal operation condition and an end-of-life condition.

4. A lighting system as in claim 1, wherein the lamp detection circuit is configured to detect the lamp type based on a detected electrical property associated with the at least one of the plurality of lamp sockets.

5. A lighting system as in claim 4, wherein the electrical property is indicative of a stage of lamp life.

6. A lighting system as in claim 5, wherein the electrical property is a voltage signal.

7. A lighting system as in claim 5, wherein the electrical property is a current signal.

8. A lighting system as in claim 1, wherein the lamp power circuit comprises a high frequency bus.

9. A lighting system as in claim 8, wherein the voltage of the high frequency bus is regulated based on the voltage command provided to the lamp power circuit.

10. A method for controlling a lighting system, the method comprising:

providing an output from a lamp detection circuit to a voltage regulator, the output based on an electrical property detected by the lamp detection circuit;

identifying a lamp type at the voltage regulator based on the lamp detection circuit output;

providing a voltage command from the voltage regulator to the lamp power circuit based on the lamp type; and adjusting the voltage applied by the lamp power circuit to at least one of a plurality of lamp sockets based on the voltage command.

11. A method as in claim 10, wherein identifying a lamp type at the voltage regulator comprises:

receiving the output from the lamp detection circuit;

comparing the output to a predetermined electrical property lookup table; and providing the voltage command corresponding to the electrical property in the electrical property lookup table to the lamp power circuit.

12. A method as in claim 11, wherein the electrical property lookup table comprises a plurality of operating ranges for a plurality of operating conditions.

13. A method as in claim 12, wherein each one of the plurality of operating ranges includes a start-up condition, a normal operation condition and an end-of-life condition.

14. A method as in claim 10, wherein providing an output from a lamp detection circuit to a voltage regulator comprises detecting an electrical property indicative of a stage of lamp life.

15. A method as in claim 14, wherein the electrical property is a current signal or a voltage signal.

16. A method as in claim 14, wherein adjusting the voltage applied by the lamp power circuit to at least one of a plurality of lamp sockets comprises reducing the voltage applied by the lamp power circuit when the electrical property indicates a lamp is in an end-of-life operating condition.

17. A method as in claim 14, wherein adjusting the voltage applied by the lamp power circuit to at least one of a plurality of lamp sockets comprises increasing the voltage applied by the lamp power circuit when the electrical property indicates a lamp is in a startup operating condition.

18. A method as in claim 14, adjusting the voltage applied by the lamp power circuit to at least one of a plurality of lamp sockets comprises decreasing the voltage applied by the lamp power circuit from a startup operating condition when the electrical property indicates a lamp is in a normal operating condition.

* * * * *